US006463721B1

(12) United States Patent
Su et al.

(10) Patent No.: US 6,463,721 B1
(45) Date of Patent: Oct. 15, 2002

(54) STRAPPING MACHINE WITH A STRAP TIGHTENING UNIT

(76) Inventors: Chi-Jan Su, No. 18, Alley 3, Lane 62, Sec. 1, Chih-Cheng Rd., Shih-Lin Dist., Taipei City (TW); Chin-Chang Liu, No. 30, Alley 13, Lane 17, Feng-Le Rd., Pai-Tun Dist., Taichung City (TW)

( * ) Notice: Subject to any disclaimer, the term of this patent is extended or adjusted under 35 U.S.C. 154(b) by 0 days.

(21) Appl. No.: 09/916,986

(22) Filed: Jul. 27, 2001

(51) Int. Cl.[7] ..... B65B 13/04; B65B 3/26; B65B 57/12; B65B 57/10; B65B 13/24

(52) U.S. Cl. ..... 53/589; 53/494; 53/67; 53/74; 100/4; 100/29

(58) Field of Search ..... 100/4, 26, 29; 53/494, 67, 74, 589

(56) References Cited

U.S. PATENT DOCUMENTS

| | | | | | |
|---|---|---|---|---|---|
| RE27,744 | E | * | 8/1973 | Billet et al. | 100/29 |
| 3,968,556 | A | | 7/1976 | Morr | |
| 4,378,262 | A | * | 3/1983 | Annis, Jr. | 100/29 |
| 4,516,488 | A | * | 5/1985 | Bartzick et al. | 100/26 |
| 4,569,186 | A | * | 2/1986 | Mori et al. | 100/29 |
| 5,267,508 | A | * | 12/1993 | Yoshino | 100/26 |
| 5,377,477 | A | * | 1/1995 | Haberstroh et al. | 100/29 |
| 5,809,873 | A | * | 9/1998 | Chak et al. | 100/26 |
| 5,823,103 | A | * | 10/1998 | Kuei | 100/26 |
| 5,921,288 | A | | 7/1999 | Barrera | |
| 6,076,338 | A | * | 6/2000 | Maeda et al. | 100/26 |

FOREIGN PATENT DOCUMENTS

| | | |
|---|---|---|
| JP | 59 014347 | 1/1984 |
| WO | WO 00/44081 | 7/2000 |

* cited by examiner

*Primary Examiner*—Anthony D. Stashick
(74) *Attorney, Agent, or Firm*—Troxell Law Office PLLC

(57) ABSTRACT

A strapping machine includes a machine body which defines a package-strapping space with a strap guide path. A package support plate is disposed above the strap guide path, and has opposite left and right sides which extend in a direction transverse to the strap guide path. A strap is fed to encircle the left and right sides of the package support plate. A swing arm is mounted pivotally to the machine body, and is turnable away from the machine body for strap tightening operation. A clamp unit is mounted movably on the swing arm. A swing lever is mounted swingeably underneath the package support plate adjacent to one of the left and right sides in such a manner that one end of the swing lever passes over the strap guide path, and that the other end of the swing lever is urged to abut against a micro switch which is electrically coupled to a driving unit for driving the clamp unit.

1 Claim, 10 Drawing Sheets

STRAPPING MACHINE WITH A STRAP TIGHTENING UNIT

BACKGROUND OF THE INVENTION

1. Field of the Invention

The invention relates to a strapping machine, more particularly to a strapping machine with a strap tightening unit which is provided with a device to prevent snapping of the strap in case the strapping machine is untimely and accidentally actuated prior to disposing a package in the machine for strapping.

2. Description of the Related Art

Referring to FIGS. 1 to 3, a conventional strapping machine is shown to include a machine body 1, a strap supply reel 11", a strap feed unit 12, a rotating shaft unit 122, and a strap tightening unit 14.

As illustrated, the machine body 1 defines an accommodating space 111 with a strap guide path 131 and a package-strapping space 112 above the accommodating space 111. The strap supply reel 11" is mounted on an exterior of the machine body 1. A bundle of strap 11 is mounted on the strap supply reel 11", and has a leading end fed into the package-strapping space 112 by the strap feed unit 12 via the strap guide path 131 so as to be retained underneath a package support plate 133. The rotating shaft unit 122 is journalled in the accommodating space 111 of the machine body 1, and is formed with a cam unit 123.

The strap tightening unit 14 includes a spring-loaded swing arm 140, and an electrically operated clamp unit 141. The swing arm 140 is mounted pivotally within the accommodating space 11 of the machine body 1, and defines a strap passage to permit extension of the strap 11 therethrough. The swing arm 140 is further associated with the rotating shaft unit 122 via the cam unit 123 in such a manner that rotation of the shaft unit 122 results in turning of the swing arm 140 relative to the machine body 1 along a travelling path from an upper position adjacent to the package-strapping space 112 toward a lower position distal from the package-strapping space 112 so as to perform the strapping operation on the package 2 that is disposed on the package support plate 133, as best shown in FIG. 2. The clamp unit 141 is mounted movably on the swing arm 140, and is movable relative to the strap passage of the swing arm 140 between a clamping position, in which the strap 11 is clamped by the clamp unit 141, and a releasing position, in which the strap 11 is released from the clamp unit 141.

One disadvantage that results during use of the aforesaid conventional strapping machine resides in that in case no package is disposed on the package support plate 133, and the shaft unit 122 is accidentally and untimely actuated so as to move the swing arm 140 to a position between the upper and lower positions for strap tightening operation, snapping of the strap 11 in the strap feed unit 12 will result by virtue of the engagement between the package support plate 133 and the strap 11 (see FIG. 3).

SUMMARY OF THE INVENTION

Therefore, the object of this invention is to provide a strapping machine with a strap tightening unit of a simple structure so as to overcome the aforementioned disadvantage that is associated with the conventional strapping machine.

Accordingly, a strapping machine of the present invention includes a machine body, a strap supply reel, a strap feed unit, a rotating shaft unit, and a strap tightening adjustment unit. The machine body defines an accommodating space and a package-strapping space above the package-strapping space. A strap guide path is disposed horizontally in the accommodating space of the machine body adjacent to the package-strapping space. A package support plate is disposed above the strap guide path, and has horizontally spaced opposite left and right sides which extend in a direction transverse to and which span the strap guide path. The strap supply reel is mounted on the machine body, and is adapted to hold a bundle of strap thereon. The strap feed unit is capable of feeding the strap from the strap supply reel to the package-strapping space for encircling the left and right sides of the package support plate via the strap guide path. The rotating shaft unit is journalled in the accommodating space of the machine body, and is formed with a cam unit. The strap tightening unit includes a spring-loaded swing arm, a driving unit, and a micro switch unit. The swing arm is pivoted to the machine body within the accommodating space, and defines a strap passage to permit extension of the strap therethrough. The swing arm is further associated with the rotating shaft unit via the cam unit in such a manner that rotation of the shaft unit results in turning of the swing arm relative to the machine body between an upper position adjacent to the package-strapping space and a lower position distal from the package-strapping space. The clamp unit is mounted movably on the swing arm, and is movable relative to the strap passage of the swing arm between a clamping position, in which the strap is adapted to be clamped by the clamp unit, and a releasing position, in which the strap is adapted to be released from the clamp unit. The driving unit rotates in a first direction for moving the clamp unit to the clamping position, and in a second direction opposite to the first direction for moving the clamp unit to the releasing position. The micro switch unit includes a micro switch which is electrically coupled to the driving unit, a swing lever which is mounted swingeably underneath the package support plate adjacent to one of the left and right sides in such a manner that one end of the swing lever passes over the strap guide path, and an urging member which urges the other end of the swing lever to abut against the micro switch.

In case no package is disposed on the package support plate, and the rotating shaft unit is accidentally and untimely actuated so as to move the swing arm to a position between the upper and lower positions for strap tightening operation, the other end of the swing lever will disengage from the micro switch via the engagement between the strap and the one end of the swing lever. Under this condition, the driving unit is signaled to rotate in the second direction so as to move the clamp unit to the releasing position on the swing arm, thereby preventing snapping of the strap in the strap feed unit.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
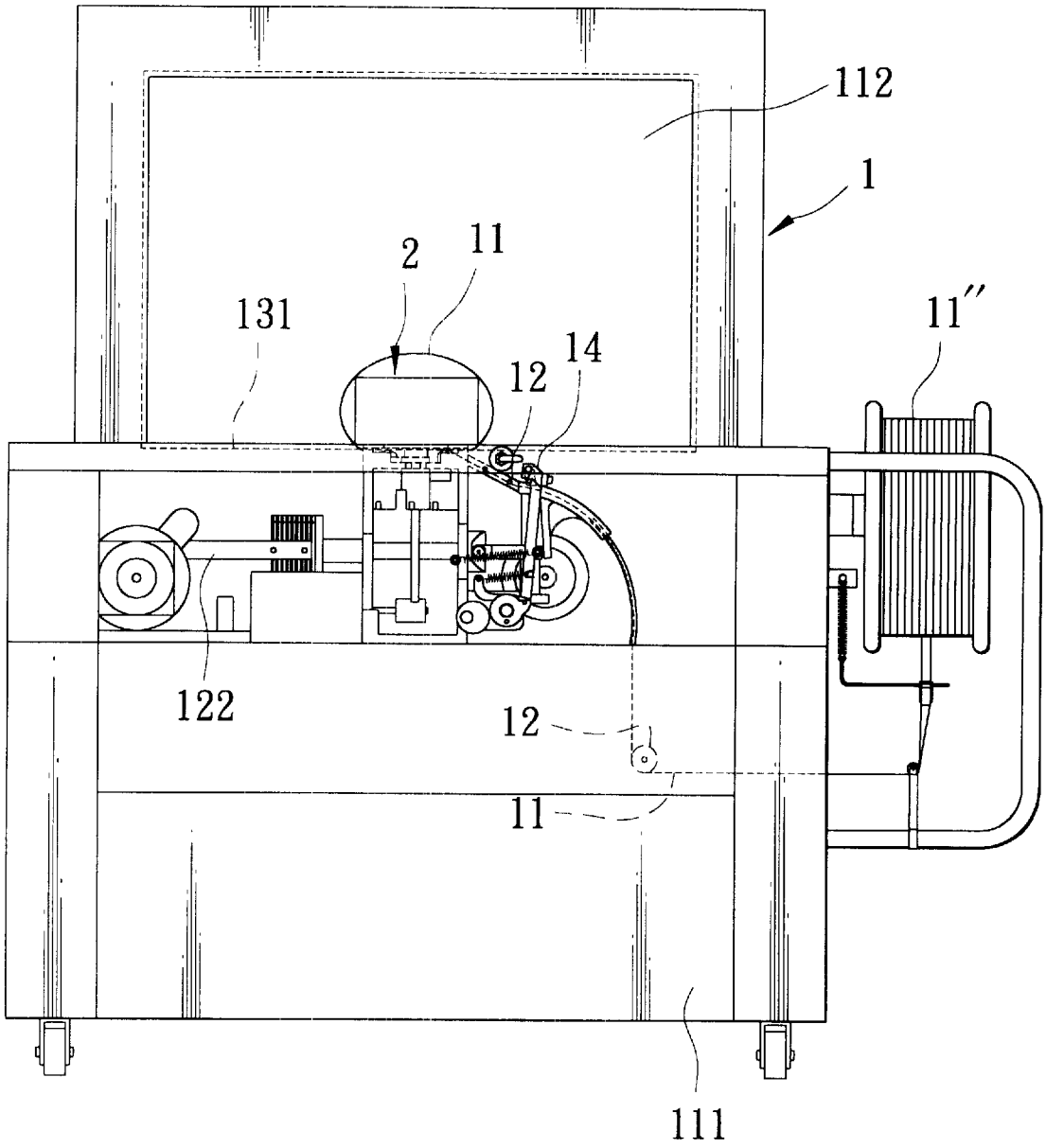
FIG. 1 PRIOR ART
FIG. 1 is a schematic view of a conventional strapping machine for strapping a package.
Figure 2:
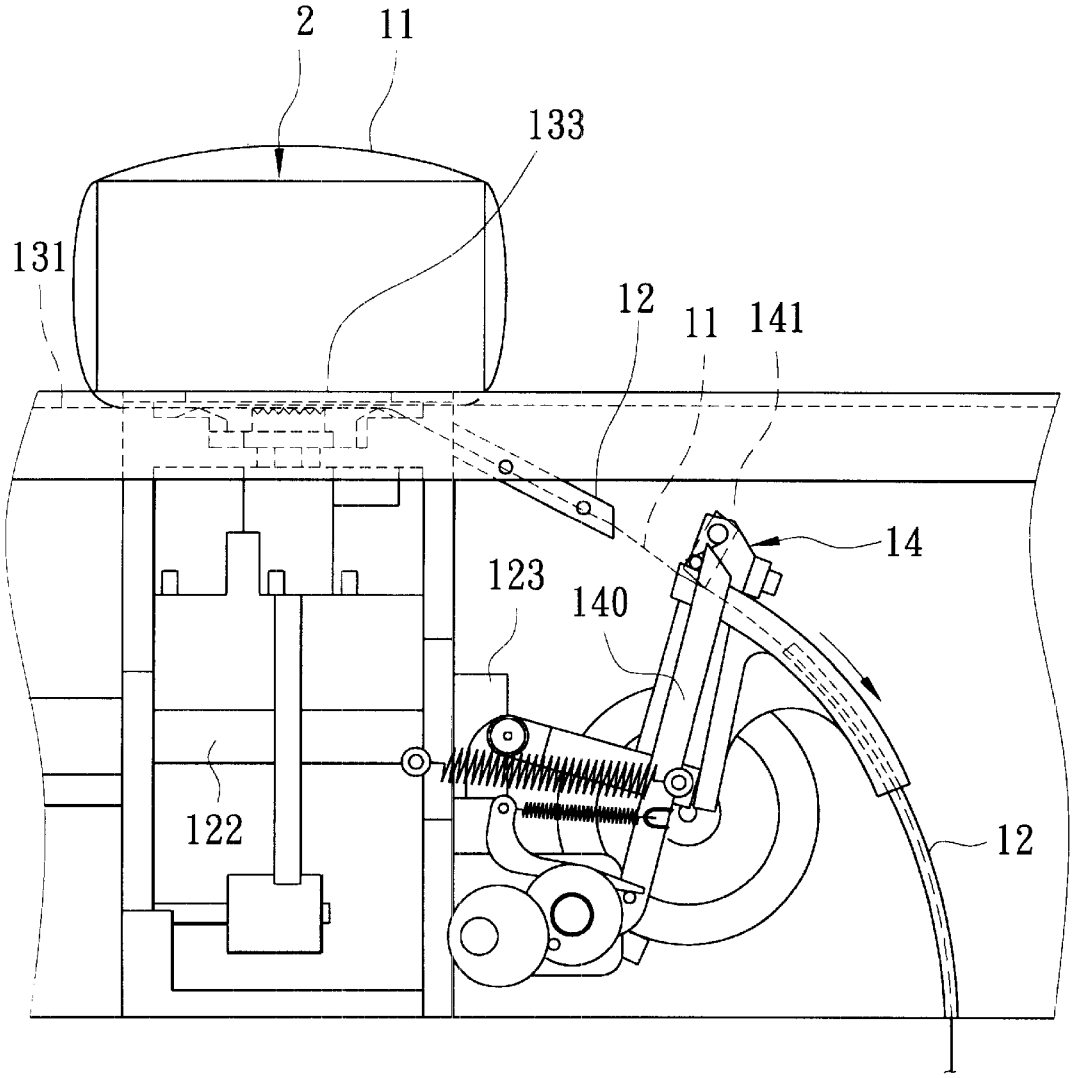
FIG. 2 PRIOR ART
FIG. 2 is a fragmentary schematic view to illustrate a strap tightening unit of the conventional strapping machine performing a strap tightening operation on a package.
Figure 3:
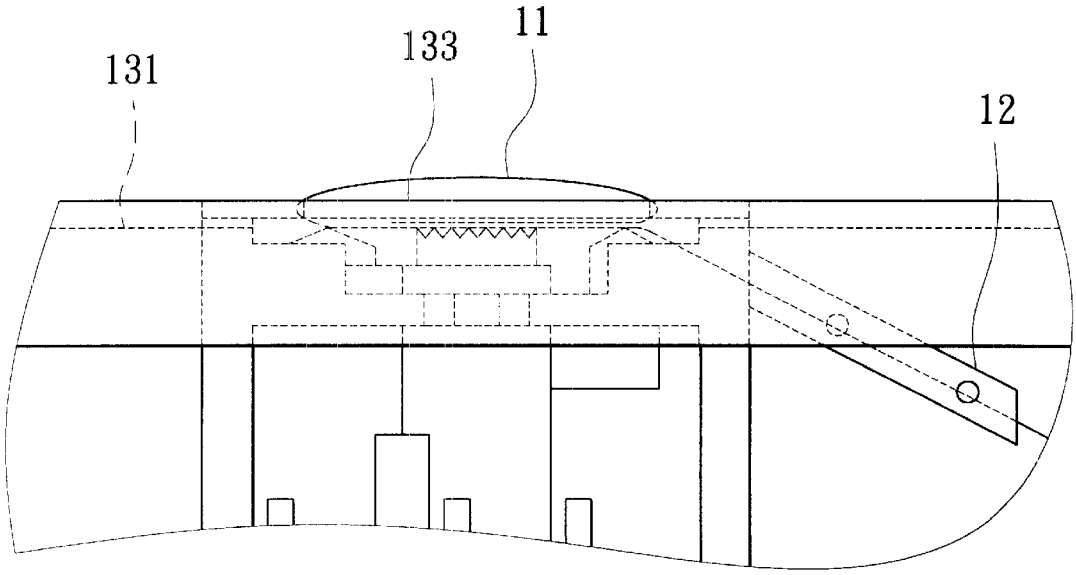
FIG. 3 PRIOR ART
FIG. 3 is a fragmentary schematic view to illustrate a strap tightening unit of the conventional strapping machine performing a strap tightening operation when no package is disposed on a package support plate.
Figure 4:
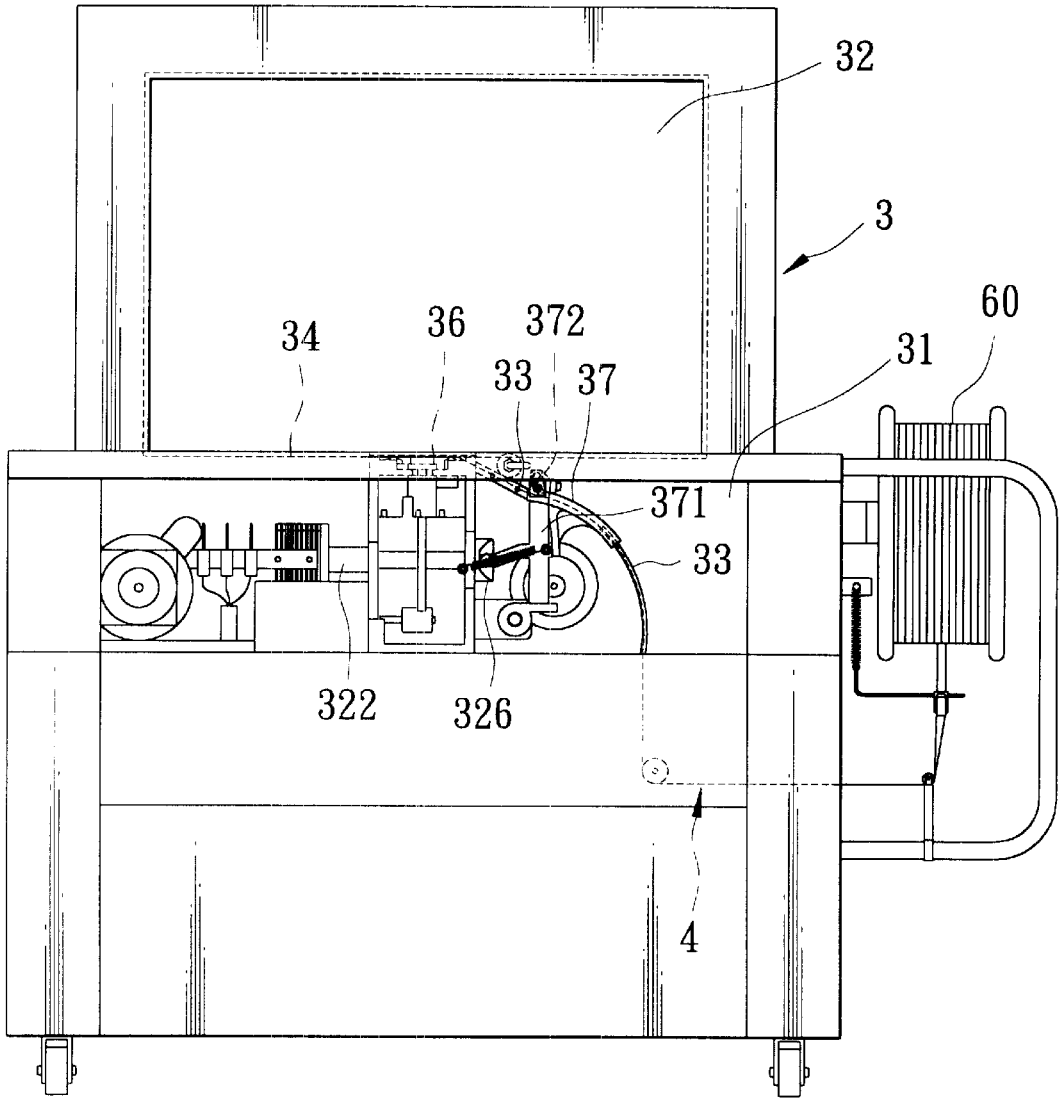
FIG. 4 is a schematic view of a preferred embodiment of a strapping machine according to the present invention.
Figure 5:
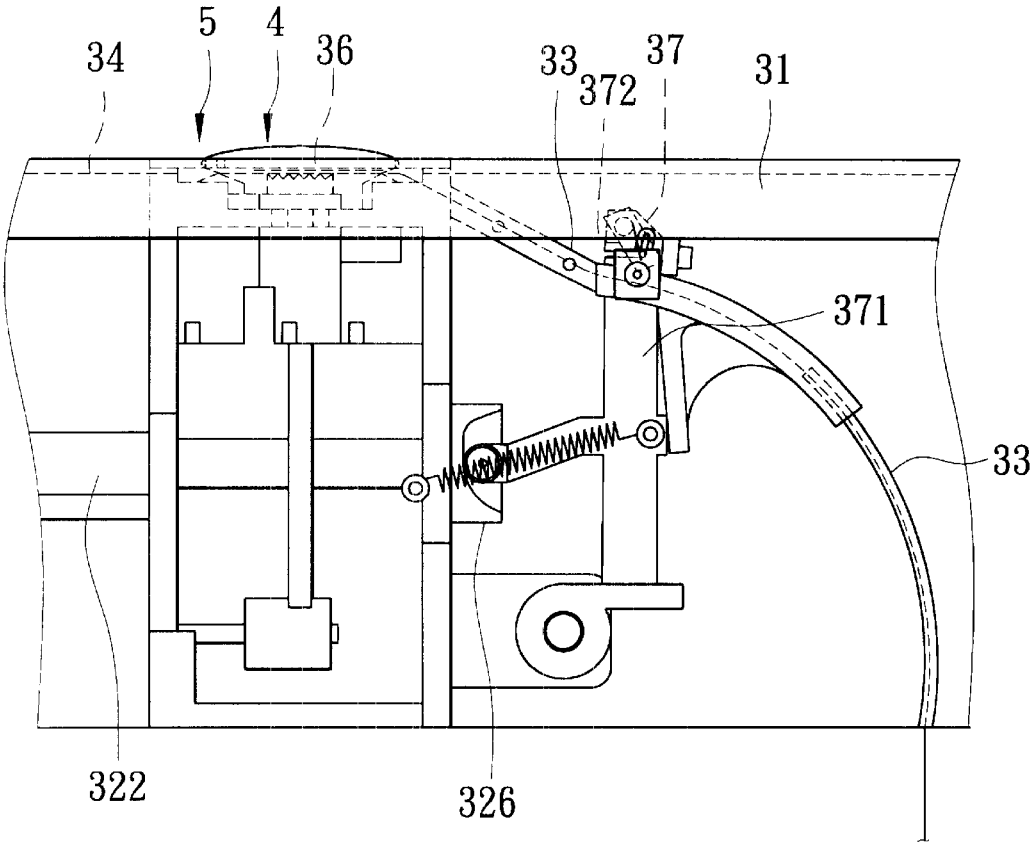
FIG. 5 is a fragmentary schematic view of the preferred embodiment, illustrating the position of a strap tightening unit prior to a strap tightening operation.

Referring to FIGS. 4 and 5, the preferred embodiment of a strapping machine for strapping a package according to the present invention is shown to include a machine body 3, a strap supply reel 60, a strap feed unit 33, a rotating shaft unit 322, and a strap tightening unit 37.

As illustrated, the machine body 3 defines an accommodating space 31 and a package-strapping space 32 above the accommodating space 31. The package can be disposed in the package-strapping space 32 of the machine body 3 for strapping. A strap guide path 34 is disposed horizontally in the accommodating space 31 adjacent to the package-strapping space 32. A package support plate 36 is disposed above the strap guide path 34, and has horizontally spaced opposite left and right sides 361, 362 (see FIG. 6) that extend in a direction transverse to and that span the strap guide path 34.

The strap supply reel 60 is mounted on and exteriorly of the machine body 3, and holds a bundle of strap 4 thereon.

The strap feed unit 33 is mounted within the accommodating space 31 of the machine body 3, and can feed the strap 4 from the strap supply reel 60 to the package-strapping space 32 for encircling the left and right sides 361, 362 of the package support plate 36 via the strap guide path 34.

The rotating shaft unit 322 is journalled within the accommodating space 31 of the machine body 3, and is formed with a cam unit 326.

Figure 6:
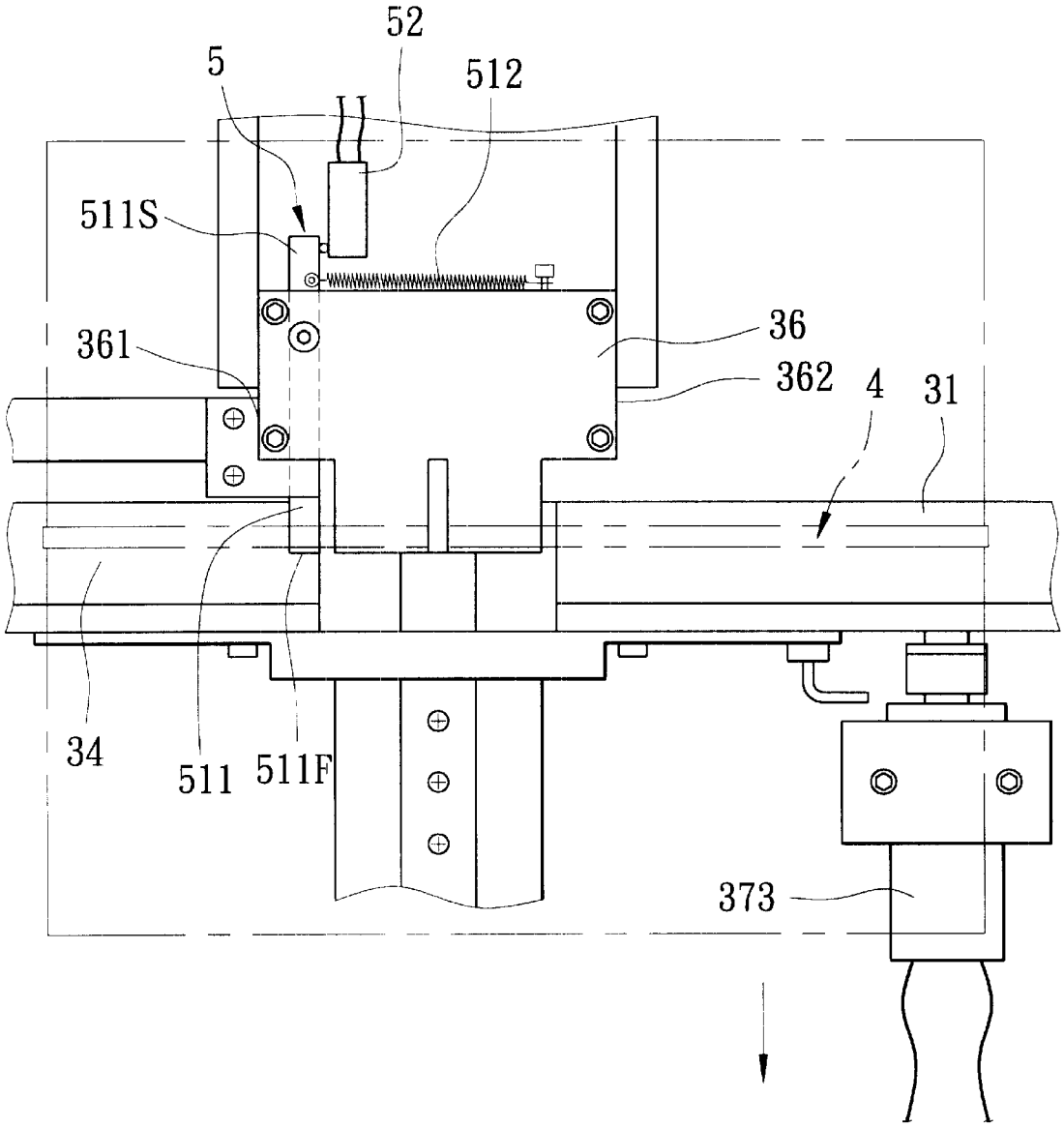
FIG. 6 is a fragmentary top view of the preferred embodiment, illustrating the position of a strap tightening unit prior to the strap tightening operation.
Figure 8:
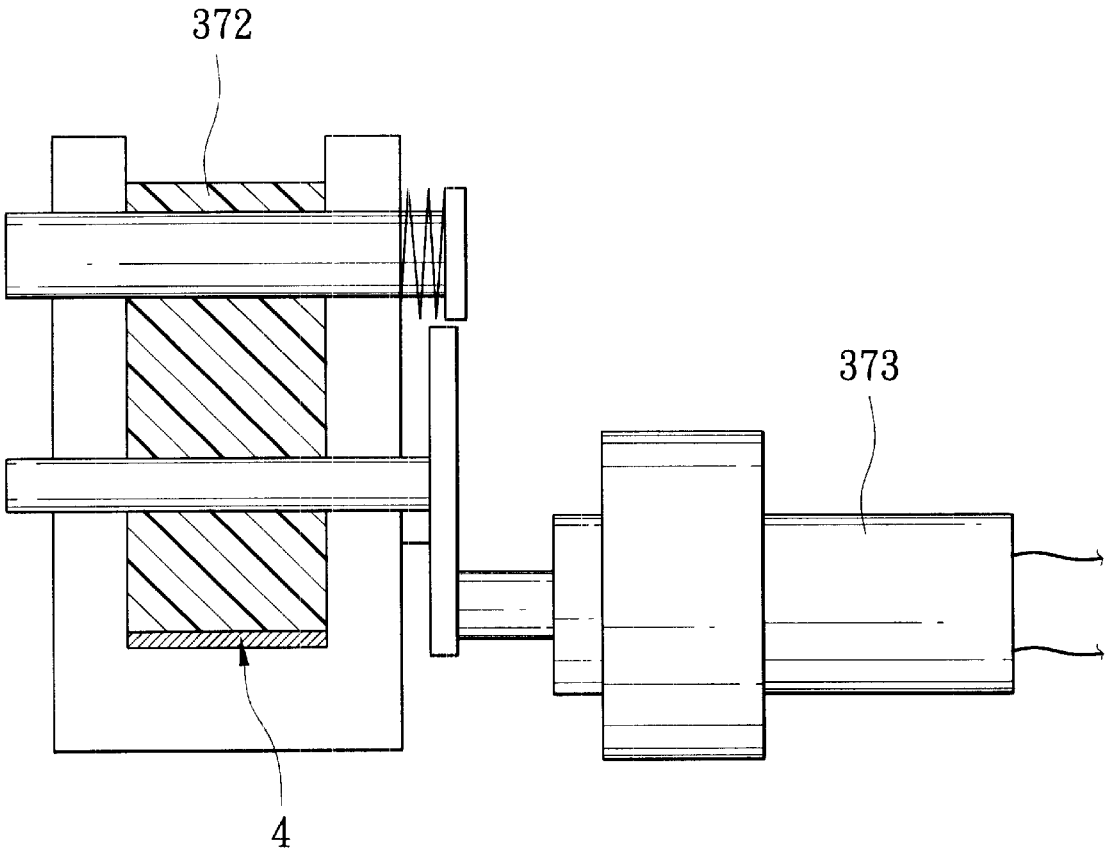
FIG. 8 is an enlarged schematic view of an electrically operated clamp unit employed in the strap tightening unit of the preferred embodiment at a clamping position.
Figure 10:
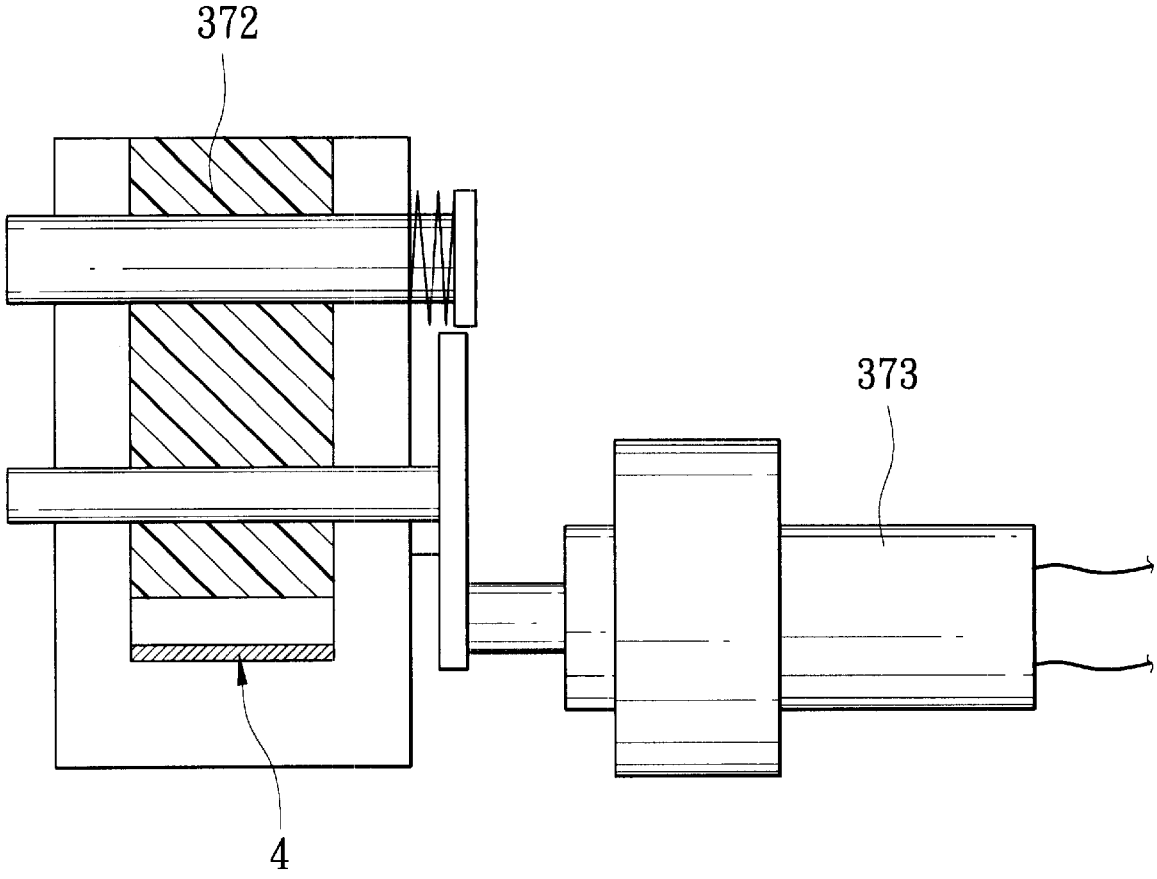
FIG. 10 is an enlarged schematic view of the electrically operated clamp unit employed in the strap tightening unit of the preferred embodiment at a releasing position.

The strap tightening unit 37 includes a spring-loaded swing arm 371, an electrically operated clamp unit 372, a driving unit 373 (see FIG. 8), and a micro switch unit 5 (see FIG. 6). The swing arm 371 is pivoted to the machine body 3 within the accommodating space 31, and defines a strap passage to permit extension of the strap 4 therethrough. The swing arm 371 is further associated with the rotating shaft unit 322 via the cam unit 326 in such a manner that rotation of the shaft unit 322 results in turning of the swing arm 371 relative to the machine body 3 between an upper position adjacent to the package-strapping space 32, as shown in FIG. 4, and a lower position (not shown) distal from the package-strapping space 32. The clamp unit 372 is mounted movably on the swing arm 371, and is movable relative to the strap passage of the swing arm 371 between a clamping position, in which the strap 4 is adapted to be clamped by the clamp unit 372, as best shown in FIG. 8, and a releasing position, in which the strap 4 is adapted to be released from the clamp unit 372, as best shown in FIG. 10.

The driving unit 373 rotates in a first direction for moving the clamp unit 372 from the releasing position to the clamping position, and in a second direction opposite to the first direction for moving the clamp unit 372 from the clamping position to the releasing position.

As shown in FIG. 6, the micro switch unit 5 includes a micro switch 52, a swing lever 511, and an urging member in the form of a tension spring 512. The micro switch 52 is electrically coupled to the driving unit 373. The swing lever 511 is mounted swingeably underneath the package support plate 36 adjacent to the left side 361 of the package support plate 36 in such a manner that a first end (511F) of the swing lever 511 passes over the strap guide path 34. The tension spring 512 interconnects the swing lever 511 and the package support plate 36 and urges a second end (511S) of the swing lever 511 to abut against the micro switch 52.

Figure 7:
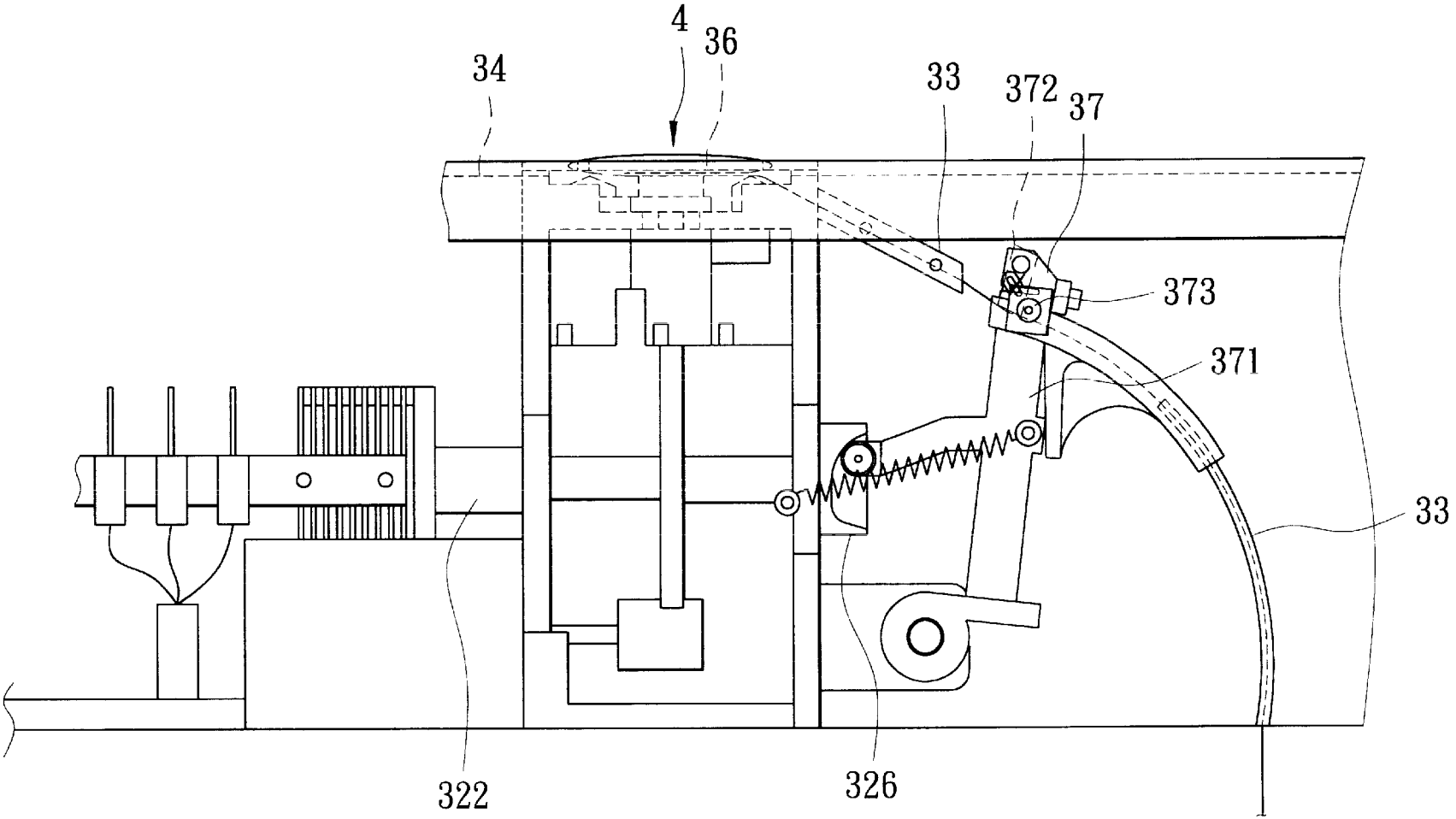
FIG. 7 is a fragmentary schematic view of the preferred embodiment, illustrating the position of the strap tightening unit during the strap tightening operation.
Figure 9:
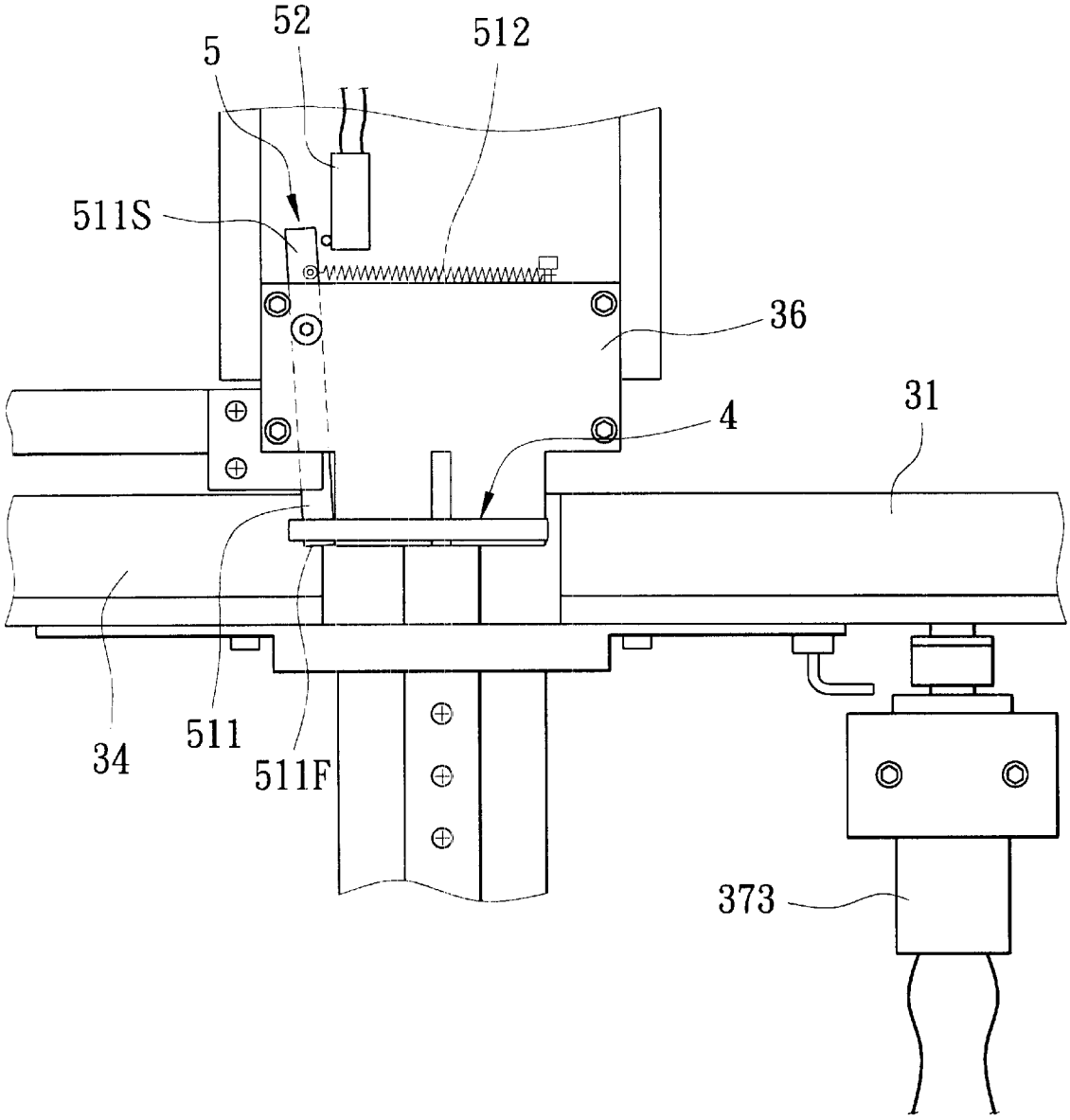
FIG. 9 is a fragmentary top view of the preferred embodiment, illustrating the position of the strap tightening unit during the strap tightening operation.

In case no package is disposed on the package support plate 36, and the rotating shaft unit 322 is accidentally and untimely actuated so as to move the swing arm 371 to a predetermined position between the upper and lower positions, as best shown in FIG. 7, for strap tightening operation, the second end (511S) of the swing lever will disengage from the micro switch 52 (see FIG. 9) by virtue of the engagement between the strap 4 and the first end (511F) of the swing lever 511. Under this condition, a signal is conveyed to the driving unit 373 to rotate in the second direction, which in turn, moves the clamp unit 372 from the clamping position to the releasing position on the swing arm 371. The strap 4 is thus prevented from snapping in the strap feed unit 33.

Referring to FIG. 6, when a package (P) (shown by dotted lines) is disposed on the package support plate 36, two opposite sides of the package P are disposed outboard to the left and right sides 361,362 of the package support plate 36. Under such a condition, during the strap tightening operation over the package (P), there is no engagement between the first end (511S) of swing lever 511 and the strap 4. After the strap tightening operation, sidewise movement of the package (P) in the arrow direction as best shown in FIG. 6 relative to the strap guide path 34 results in removal of the package (P) from the package support plate 36.

Since the structures of the rotating shaft unit 322, and the clamp unit 372 are not pertinent to the present invention, a detailed description of the same is omitted herein for the sake of brevity.

With this invention thus explained, it is apparent that numerous modifications and variations can be made without departing from the scope and spirit of this invention. It is therefore intended that this invention be limited only as indicated in the appended claims.

We claim:

1. A strapping machine for strapping a package, comprising:

a machine body defining an accommodating space and a package-strapping space above said accommodating space;

a strap guide path disposed horizontally in said accommodating space adjacent to said package-strapping space;

a package support plate disposed above said strap guide path, and having horizontally spaced opposite left and right sides extending transverse to and spanning said strap guide path;

a strap supply reel mounted on said machine body and adapted to hold a bundle of strap thereon;

a strap feed unit capable of feeding the strap from said strap supply reel to said package-strapping space for encircling said left and right sides of said package support plate via said strap guide path;

a rotating shaft unit journalled in said accommodating space of said machine body, and formed with a cam unit;

a strap tightening unit including a spring-loaded swing arm pivoted to said machine body within said accommodating space, defining a strap passage to permit extension of the strap therethrough, and associated with said rotating shaft unit via said cam unit in such a manner that rotation of said shaft unit results in turning of said swing arm relative to said machine body between an upper position adjacent to said package-strapping space and a lower position distal from said package-strapping space, a clamp unit mounted movably on said swing arm and movable relative to said strap passage of said swing arm between a clamping position, in which the strap is adapted to be clamped by said clamp unit, and a releasing position, in which the strap is adapted to be released from said clamp unit, a driving unit rotating in a first direction for moving said clamp unit to said clamping position, and in a second direction opposite to said first direction for moving said clamp unit to said releasing position, and a micro switch unit including a micro switch electrically coupled to said driving unit, a swing lever mounted swingeably underneath said package support plate adjacent to one of said left and right sides in such a manner that one end of said swing lever passes over said strap guide path, and an urging member urging the other end of said swing lever to abut against said micro switch;

wherein, in case no package is disposed on said package support plate and said rotating shaft unit is accidentally and untimely actuated so as to move said swing arm to a position between said upper and lower positions for strap tightening operation, the other end of said swing lever will disengage from said micro switch via engagement between the strap and said one end of said swing lever, thereby signaling said driving unit to rotate in said second direction so as to move said clamp unit to said releasing position on said swing arm and so as to prevent the strap from snapping in said strap feed unit.

* * * * *